US005927897A

United States Patent [19]

Attar

[11] Patent Number: 5,927,897

[45] Date of Patent: Jul. 27, 1999

[54] HOUSINGLESS ABRASION RESISTANT PAVEMENT MARKER

[76] Inventor: Adil Attar, P.O. Box 1280, Ontario, Calif. 91762-9991

[21] Appl. No.: 08/863,901

[22] Filed: May 27, 1997

Related U.S. Application Data

[63] Continuation-in-part of application No. 08/502,149, Jul. 14, 1995, abandoned.

[51] Int. Cl.[6] ..... E01F 9/06

[52] U.S. Cl. ..... 404/12; 404/14; 404/16

[58] Field of Search ..... 404/13, 14, 15, 404/16, 12; 359/529, 530; 116/63 R

[56] References Cited

U.S. PATENT DOCUMENTS

| | | | |
|---|---|---|---|
| 3,693,511 | 9/1972 | Medynski | 404/16 X |
| 3,712,706 | 1/1973 | Stamm | 350/103 |
| 3,836,226 | 9/1974 | Cechetini | 404/14 X |
| 3,936,208 | 2/1976 | Baynes et al. | 404/16 |
| 4,070,095 | 1/1978 | Suhr | 404/14 X |
| 4,202,600 | 5/1980 | Burke et al. | 350/103 |
| 4,208,090 | 6/1980 | Heenan | 404/14 X |
| 4,232,979 | 11/1980 | Johnson, Jr. et al. | 404/16 |
| 4,236,788 | 12/1980 | Wyckoff | 404/14 X |
| 4,498,733 | 2/1985 | Flanagan | 350/102 |
| 4,726,706 | 2/1988 | Attar | 404/14 |
| 4,753,548 | 6/1988 | Forrer | 404/15 |
| 4,797,024 | 1/1989 | Forrer | 404/16 |
| 4,875,798 | 10/1989 | May | 404/14 X |
| 5,002,424 | 3/1991 | Hedgewick | 404/14 |
| 5,061,114 | 10/1991 | Hedgewick | 404/14 |
| 5,194,113 | 3/1993 | Lasch et al. | 404/14 X |
| 5,268,217 | 12/1993 | Kimock et al. | 428/216 |
| 5,340,231 | 8/1994 | Steere et al. | 404/14 |
| 5,392,728 | 2/1995 | Speer et al. | 404/16 X |
| 5,393,166 | 2/1995 | Stock et al. | 404/16 X |
| 5,470,170 | 11/1995 | Lindner | 404/14 X |
| 5,501,545 | 3/1996 | Walter | 404/16 X |
| 5,667,335 | 9/1997 | Khieu et al. | 404/14 |

FOREIGN PATENT DOCUMENTS

| | | | |
|---|---|---|---|
| 2434064 | 1/1976 | Germany | 404/16 |

*Primary Examiner*—James A. Lisehora

[57] ABSTRACT

A housingless abrasion resistance reflective pavement marker is disclosed. The marker comprises a housingless, flat topped body and a reflective member embeded in the body.

The body can be made of abrasion and impact resistant curable resinous filler material such as epoxy or polyester resin. The body and the reflective member can be coated with high abrasion resistance diamond like carbon film to enhance durability and retain reflectivity. The filler can be an inert additive material.

The reflective member can have light reflecting cells on its inner surface. The reflective member can be protected by a variety of abrasion and impact reducing ridges and webs. Also disclosed is a method for making housingless reflective pavement marker in an open mold.

3 Claims, 2 Drawing Sheets

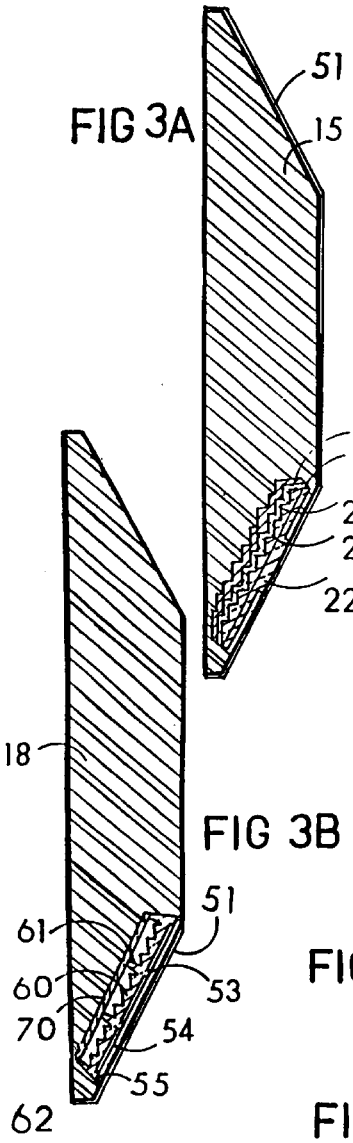
FIG 3A
51
15
23
24
25
21
22
18
FIG 3B
51
61
60
53
70
54
55
62
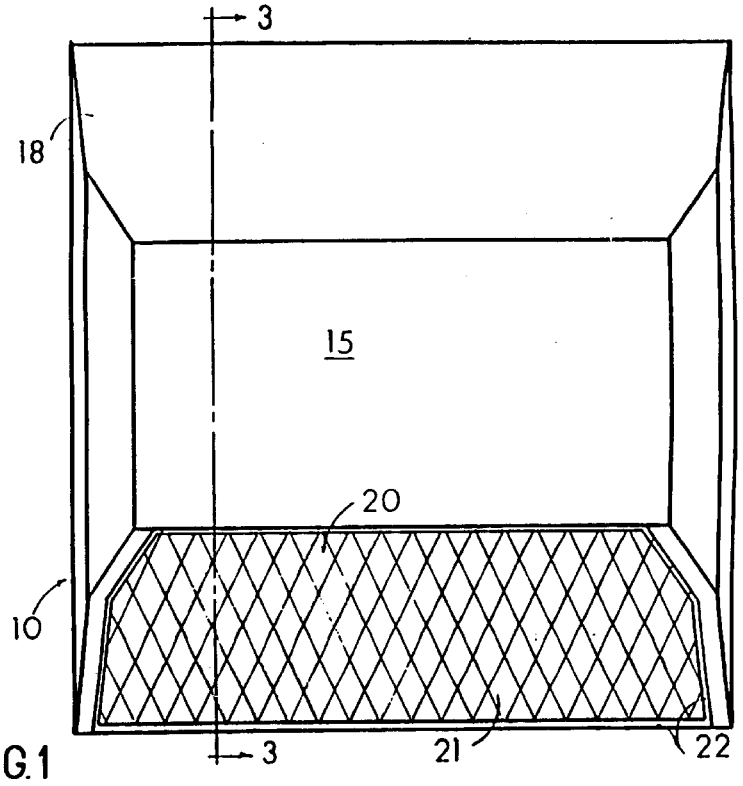
3
18
15
20
10
3
21
22
FIG.1
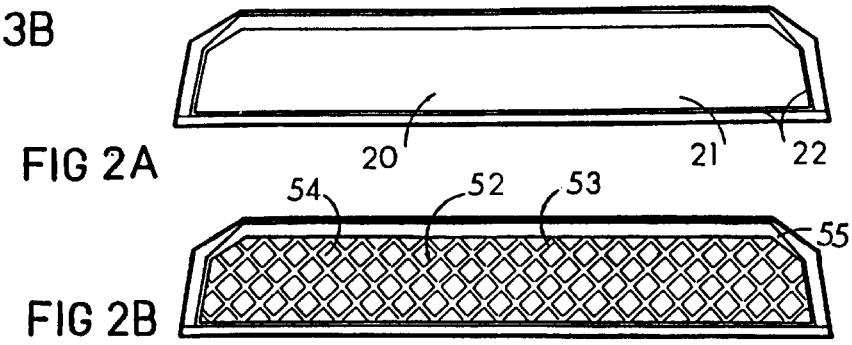
20
21
22
FIG 2A
54
52
53
55
FIG 2B
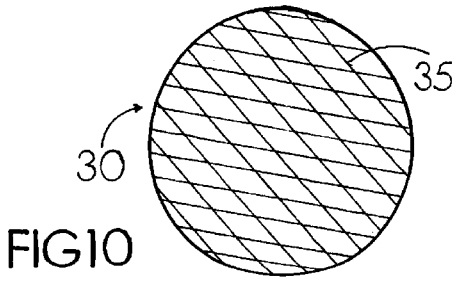
35
30
FIG10
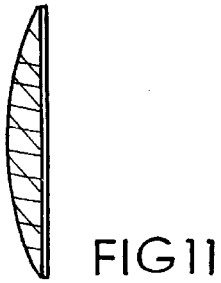
FIG11

HOUSINGLESS ABRASION RESISTANT PAVEMENT MARKER

This application is a continuation-in-part of application Ser. No. 08/502,149, filed Jul. 14, 1995, now abandoned.

BACKGROUND

The present invention is directed to a reflective pavement marker without a housing or exterior shell. The reflective members are embedded in the housingless body itself The marker can be both abrasion and impact resistant. the present invention is also directed for a method of making housingless reflective pavement marker. A reflective pavement marker can be mounted on highways to serve as perimeter, center and lane marker.

The reflective pavement marker generally requires a housing or plastic shell that act as a protective casing and to enclose the resinous filler material to form the body of the marker. The reflective member can be made up of many individual light reflecting elements or cells on the inner surface of the reflective member of the housing. the reflective member gives nighttime visibility of the marker by reflecting the headlights of oncoming traffic. A marker with a housing can be expensive, due to the thermoplastic material required to form a housing and the additional manufacturing steps required to form a marker with a housing.

Additionally, a housing is subject to deterioration, cracking and breakage due to vehicular impact and environmental influences. A cracked or broken housing can permit water to come into contact with the reflective elements. Water can have a damaging effect on the reflective elements.

Water and environmental exposure can result in etching and destruction of the reflective elements.

Previously a solution has been made by developing a housingless marker made of thermoplastic material that is subject to deterioration due to abrasion and the tendency to being dislodged from pavement surface due to incombatibility with the adhesive material used to aglutinate such marker on the pavement surface.

Thus, a need exist for an inexpensive, functional reflective pavement marker that solves the problem of housing and subsequent distruction of the reflective elements deterioration due to abrasion and environmental influences.

SUMMARY

The present invention satisfies this need by providing a reflective pavement marker that dispenses altogether with any housing or shell. The present marker comprises a housingless body and a reflective member embedded in the body material itself. The body of the marker has a flat top surface. The reflective member is made up of reflective elements or prisms. The reflective member can be protected by a variety of abrasion and impact reducing ridges and wibs. The reflective elements or cells are protected by being placed on the inside surface of the reflective member. A cell can be rhomboid, hexagonal or square shaped. Further protection for a reflective member and the cells can be obtained by securely embedding the reflective member in the filler material with the reflective elements being on the inside surface aglutinated to the filler material. An improved abrasion and impact resistance housingless marker can be obtained by making the marker from a curable resinous material with inert additives such as silica, calcium carbonate, ground glass or other abrasion and impact improving additives. The housingless body can be casted in an open mold with at least the periphery walls and the prism (inner) side of the reflective member embedded in the body. Preferably, the reflective members molded separately, of a clear plastic material.

The housingless body together with the embedded reflective members can be coated with diamond like carbon film, for abrasion resistance.

DRAWINGS

FIG. 1 is plan view of one embodiment of the pavement marker.

FIG. 2A is an elevation view of the pavement marker shown in FIG. 1.

FIG. 2B is another elevation view of the pavement marker shown in FIG. 1 with reflective member having raised ridges on the outside faces.

FIG. 3A is a sectional view taken along line 3—3 of the marker shown in FIG. 1 showing a metalized reflective elements.

FIG. 3B is a sectional view taken along line 3—3 of another embodiment of the marker shown in FIG. 1 showing reflective elements within rhombic cells.

FIG. 10 is a plan view of another embodiment of a marker of the present invention having spherical shaped body.

FIG. 11 is an elevation view of the marker of FIG. 10.

DESCRIPTION

Figure 8:
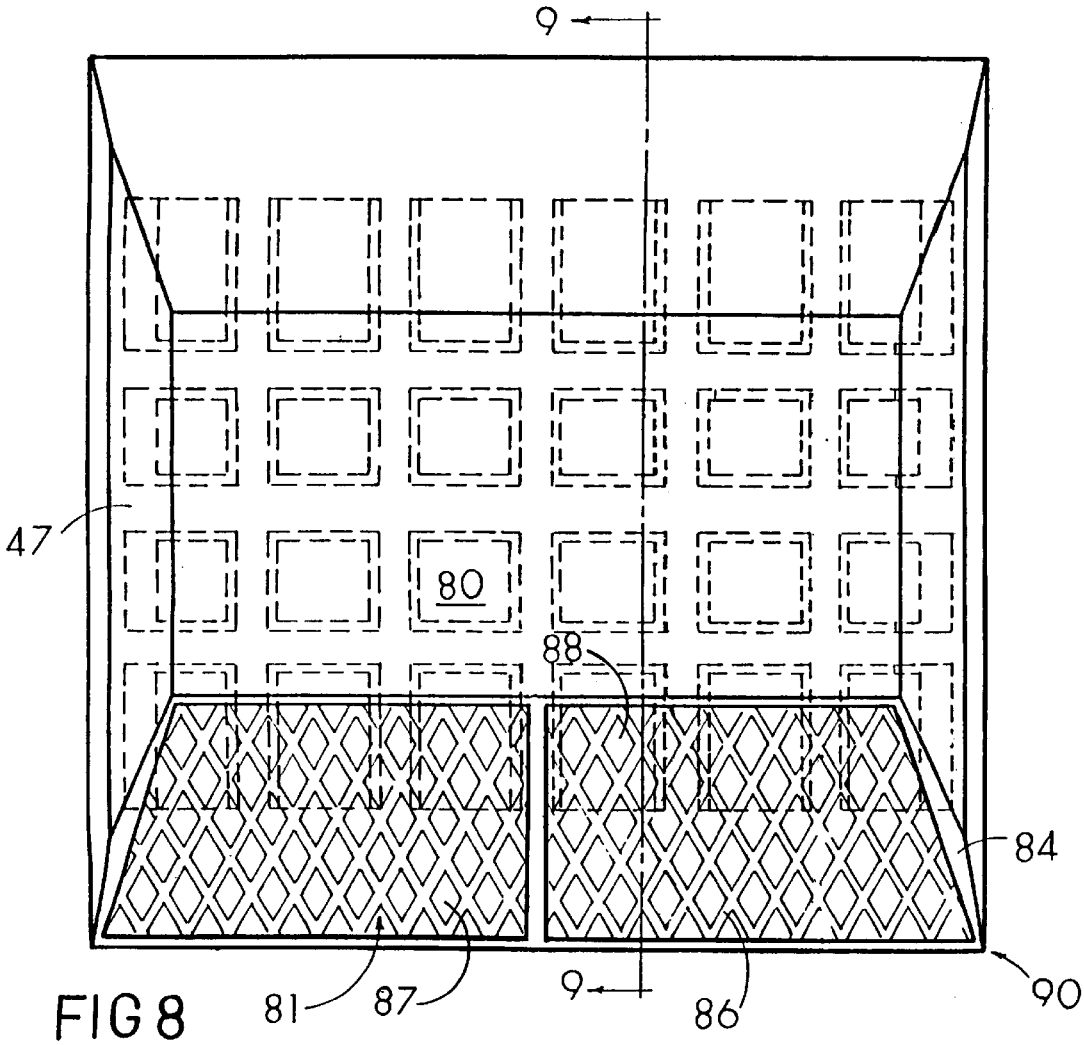
FIG. 8 is a plan view of another embodiment of a marker of the present invention.

FIGS. 1 through 3B show a preferred embodiment of the reflective pavement marker 10. Marker 10, comprises a housingless, flat top body 15 and a reflective member 20. Reflective member 20 is embedded in body 15. Body 15 is made of a curable resinous material. The resinous material can contain substantial amount of an inert additives. The inert additives can significantly improve abrasion and impact resistance to the cured resinous body 15. Only the outer surface of reflective member 20 embedded in body 15 is exposed to the external environment.

The resinous material can be chosen from a wide variety of suitable materials such as epoxy, polyester and polyurethane resins. ABS (butyl styrenes) can also be used. Preferably, the resinous material is an organic resinous material such as a curable polyester or epoxy resin. Such resinous materials are durable and show resistace to the degrading effects of long term environmental exposure, such as, for example, exposure to weathering and ultraviolet light. Polyester resins are generally less expensive than epoxy resins. Epoxy resins are preferred when automated marker production methods are used because of thier superior structural characteristics, including high flextural stress and impact resistance and good adhesion to highway substrate.

The resinous material preferably contains substantial amount of inert additives, such as, for example, silica, calcium carbonate, ground glass or combination thereof, such an additive can help give abrasion and impact resistance to body 15. The filler material can contain from about 50% to about 80% by weight of such an additive.

The reflective member 20 can be made of a reflective plastic material such as polymethacrylate resin. The reflective member 20 can have an outside reflective face, the reflective face can have a planar surface 21 that can be adapted to intercept light. The reflective face can also have periphery walls 22. The reflective face can be divided by either diamond, hexagonal or square shaped abrasion reducing raised ridges. The reflective member can have an inside surface with a plurality of reflective elements or prisms 25. The reflective elements 25 can comprise cube corner reflective prisms. The reflective elements 25 can be coated with metal layer to retain the reflectivity of the cube corner reflective elements during casting process of body 15.

In another preffered embodiment of the invention, reflective member 20 of the road marker 10 can be replaced by reflective member 52, as shown in FIGS. 2B and 3B. Reflective member 52 can have an outside surface divided into diamond,hexagonal or square shaped abrasion reducing and load transferring raised ridges 53. Ridges 53 can act as trusses to help carry and distribute load. Ridges 53 can be an integral part of the reflective member 52 and can be slightly raised from the outer surface of the reflective member 52.

Additionally, ridges 53 can help define planar surface 54 of the rhombic, hexagonal or square shaped cells. Periphery walls 55 serve to tightly hold the reflective face onto the open mold during casting. The inside surface of reflective member 52 can be divided into rhombic, hexagonal or square shaped cells 60 corresponding to planar surfaces 54 on the outside surface of reflective member 52. Cell 60 can have one or more reflective elements 62. Cells 60 can be seperated from each other by partition, impact and load carrying walls 61. Walls 61 can also act to independently transfer impact load from the reflective face to body 15. Reflective elements 62 can comprise cube corner reflective prisms.

The inside surface of the reflective member 52 can be sealed with any material of lower density or backing sheet 70. Backing material 70 can be made of an organic material. Reflective member 52 can be placed in an open mold that has a slightly raised area so that periphery walls 55 fit firmly onto said raised portion of the open mold, thereby sealling the planar surfaces 54 prior to casting body 15, in this process reflective member 52 become permanently embedded in body 15 without additional step.

Body 15 of marker 10 made of filled resinous material form very high abrasion resistant exterior surface, due to settlement of the inert filler materials.

Body 15 together with the embedded reflective member 52 or just the outside surface of the reflective member 52, can be coated with diamond like carbon film 51, utilizing the process of vacuum evaporation with Ion enhanced deposition methods or other abrasion resistant coating methods. By condensation of energetic Ionized carbon particles, a layer of super hard thin film bombard the substrate.

In this art the substrate is the outside surface of body 15 and reflective member 52. Several remarkable properties can be achieved via this carbonaceous thin film coating, include great hardness, low surface friction, high reflective index and total transparency. This diamond like coating can be used on any kind of pavement marking including, reflective marker having a housing with at least one reflective member. The reflective member having an inside surface with metalized reflective elements and outside surface with raised ridges and non reflective marker made of resinous material with or without raised ridges on the outside surface.

Although the hardness of this coating is higher than all other hard materials except diamond, it has high compressive stress within the ionized carbon layers. This may cause serious problems because buckling and lift-off of the film from the substrate may take place due to dynamic forces of automotive tires.

This art utilizes raised ridges 53 on the outside faces of reflective member 52 to eliminate such contacts between the dynamic force of automotive tires and the diamond like coating of the reflective face thereby eliminate lift-off or buckling of the said coating. Likewise using raised ridges 53 on the faces of reflective member 52 will not fully protect reflective faces from bombardment by inert debris on the roadways carried by wind action, unless a superhard diamond like coating is applied which will exceed in hardness all other materials within roadway invironment. Any desired color of the marker can be achieved by pigmentation. The resinous material from which body 15 is made can be pigmented or a gel coat can be applied to the open mold surface with a thin pigmented layer.

Figure 9:
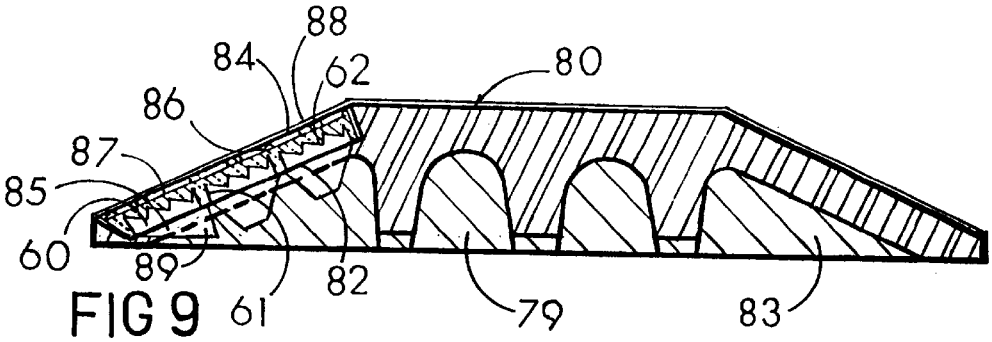
FIG. 9 is a cross- sectional view taken along line 9—9 of the marker in FIG. 8

Another preferred embodiment of the invention is in FIG. 8 and 9. Marker 90 can comprise rigid body 80. Body 80 can be made of organic resinous material such as ABS or Polycarbonate and a reflective member 81 Reflective member 81 can be embedded in the corresponding, slightly recessed side 82, bounded by raised walls 84 ,either on one side or two opposite sides of body 80 Body 80 can have multi-anguler sides 47 designed to lower the vehiculer impact force.

Reflective member 81 can have an outside surface with abrasion resistant and load transferring ridges 86. Ridges 86 help define the planar surfaces of rhombic,hexagonal or square shaped cells 87. Cells 87 can be adopted to intercept light.The outside surface of reflective member 81 can be coated with abrasion resistance diamond like carbon film 88. The inside surface of reflective member 81 can be divided into either rhombic, hexagonal or square shaped cells 60 corresponding to planar cells 87 on the outside of reflective member 81 Each cell 60 can have one or more reflective element 62.

Figure 4A:
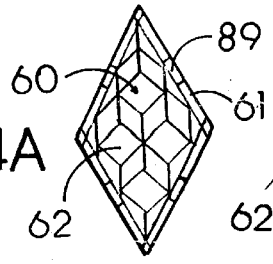
FIG. 4A is a view of a rhombic shaped cell housing the reflective elements.
Figure 4B:
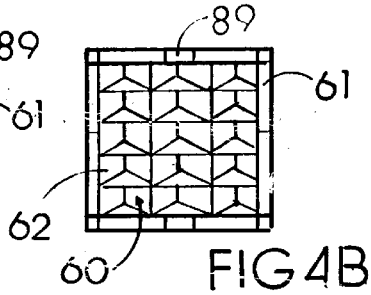
FIG. 4B is a view of a square shaped cell housing the reflective elements.
Figure 4C:
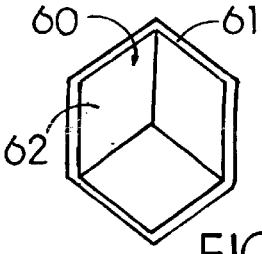
FIG. 4C is a view of a hexagonal shaped cell housing the reflective elements.

A preferred embodiments of cell 60 shown in FIGS. 4A, 4B and 4C. Cells 60 can be isolated from each other by partition and load carrying walls 61. Walls 61 each having a holding pin 89 that extend beyond the raised corners of all the three mutually intersecting surfaces of the reflective elements 62 within each cell. By inserting the reflective member 81 into the corresponding recessed side 82, the holding pins 89 will go through each corresponding slot 85. Body 80 can have hollow recesses 83 within the bottom portion of body 80. Hollow recesses can be filled with a sealer material 79 needed to seal and strengthen portion of the holding pins 89 that inserted through the corresponding slots 85 within the recessed side 82.

The reflective pavement markers of the present invention can be of any size and shape that conform to any roadway specifications. The most commonly acceptable sizes of a truncated pavement marker for roadway usage have bottom surface dimensions of 4 by 4 inches, 2.25 by 4.6 inches or 3 by 5 inches with any specified height. A preferred shape of the marker is a truncated pyramid. This form assumes a low profile on a roadway surface and help distribute and transfer impact loads.

The present invention includes within its scope a method for making a reflective Pavement marker. A suitable method can include the steps of, firstly, selecting a curable resinous material, a mold with at least one raised surface, and a reflective member. The next step would be, placing the reflective member on the raised portion of the mold. The resinous material is then injected or poured into the mold. After the resinous material cure, the reflective member become securely embedded in the hardened resinous body.

The housingless marker then coated with the diamond like carbon film, by using ion assisted vacuum deposition. This film has the highest scratch resistance strenght. Reflective member 20 can be metalized and coated with a seal coat from the inside and the outside surface coated with the diamond like carbon film before placed in the mold. The inside surface of the reflective member 20 with the metelized reflective elements and the the periphery walls 22 will be embedded in the curable resinous material.

The present pavement marker has at least the following advantages:

1. Improved abrasion and impact resistance due to high inert content and one piece body molding.
2. Superior protection of the reflective members due to slightly recessed faces and the raised ridges and webs.
3. Superior scratch resistance due to the diamond like coating of the outer surface of the body and the reflective members.
4. Less expensive because it is housingless.

Although the present invention has been described in considerable detail with reference to certain preferred versions or embodiments thereof other versions are possible, for example, the marker can have a base with more than four sides, it can have housing with at least one reflective member having an outside surface either with or without raised diamond or square shaped ridges, the outside surface being coated with the diamond like carbon film and an inside surface with metallized reflective elements. Additionally, wide variety of filler materials and additives can be used. Therefore, the spirit and scope of the appended claims should not necessarilly be limited to the description of the preferred versions contained herein.

What is claimed is:

1. An abrasion and impact resistant housingless reflective pavement marker comprising:

(a) an integrally molded, multisided, flat topped housingless body including hollow recesses within a flat base, said body being made of organic resinous material having a slightly recessed side, bounded by raised abrasion and impact reducing periphery walls, said recessed side having slots open to the hollow recesses of the flat base of the housingless body;

(b) at least one preformed reflective member embedded in the slightly recessed side of the housingless body, the reflective member having an outside planar surface being integrally divided by abrasion reducing and load carrying raised ridges, said reflective member having an inside surface comprising a plurality of light reflecting cells, each cell having at least one cube-corner reflective element, said light reflecting cells being either rhomboid, square or hexagonal in shape, said cells being isolated from each other by load carrying walls, each of said walls having a holding pin protruding slightly above the cube-corner reflective elements, said holding pins being tightly inserted into the slots within the slightly recessed side of the housingless body.

2. The pavement marker as claimed in claim 1, further comprising a sealer applied inside the hollow recesses of the flat base of the housingless body to seal and agglutinate the protruding portion of the holding pins, said sealer made of resinous material, said pavement marker, wherein the outside surface of the reflective member being coated with abrasion resistance diamond like carbon film.

3. An abrasion and impact resistant pavement marker, comprising:

(a) integrally molded, round flat base with hollow recesses and spherical shaped body made of organic resinous material, said spherically shaped body having an outside surface integrally divided by either rhombic or square shaped abrasion and impact reducing raised ridges; and (b) an outside surface of the spherically shaped body being coated with diamond like carbon film for abrasion and scratch resistance.

* * * * *

UNITED STATES PATENT AND TRADEMARK OFFICE

CERTIFICATE OF CORRECTION

PATENT NO. : 5,927,897

DATED : Jul. 27, 1999

INVENTOR(S) : ADIL ATTAR

It is certified that error appears in the above-identified patent and that said Letters Patent is hereby corrected as shown below:

On the title page, item [76]

Inventor address to be P.O.Box 3883
Ontario, California 91761

Signed and Sealed this

Eighteenth Day of January, 2000

*Attest:*

*Attesting Officer*

Q. TODD DICKINSON

*Commissioner of Patents and Trademarks*